US010605550B1

(12) United States Patent
Heizer et al.

(10) Patent No.: US 10,605,550 B1
(45) Date of Patent: Mar. 31, 2020

(54) FIREARM QUICK RELEASE PIN WITH ARM EXTENSION

(71) Applicant: Heizer Defense, LLC, Pevely, MO (US)

(72) Inventors: Charles K. Heizer, St. Louis, MO (US); Thomas C. Heizer, St. Louis, MO (US); John C. Robinson, Festus, MO (US); Jacob W. Mahn, Bloomsdale, MO (US)

(73) Assignee: Heizer Defense, LLC, Pevely, MO (US)

( * ) Notice: Subject to any disclaimer, the term of this patent is extended or adjusted under 35 U.S.C. 154(b) by 0 days.

(21) Appl. No.: 16/104,641

(22) Filed: Aug. 17, 2018

Related U.S. Application Data

(63) Continuation-in-part of application No. 15/823,100, filed on Nov. 27, 2017, now Pat. No. 10,054,381.

(60) Provisional application No. 62/426,965, filed on Nov. 28, 2016.

(51) Int. Cl.

| | |
|---|---|
| ***F41A 3/66*** | (2006.01) |
| ***F41A 11/00*** | (2006.01) |
| ***F41A 21/48*** | (2006.01) |
| ***F41A 3/86*** | (2006.01) |
| ***F41C 3/00*** | (2006.01) |

(52) U.S. Cl.
CPC ..... *F41A 3/66* (2013.01); *F41A 3/86* (2013.01); *F41A 21/484* (2013.01); *F41C 3/00* (2013.01)

(58) Field of Classification Search
CPC .... F41A 3/64; F41A 3/66; F41A 11/00; F41A 11/02; F41A 11/04; F41A 21/48; F41A 21/484; F41A 21/488
See application file for complete search history.

(56) References Cited

U.S. PATENT DOCUMENTS

| | | | | | |
|---|---|---|---|---|---|
| 889,279 | A * | 6/1908 | Warnant | F41A 11/04 | 42/44 |
| 1,333,571 | A * | 3/1920 | Pedersen | F41A 17/38 | 42/75.01 |
| 1,333,572 | A * | 3/1920 | Pedersen | F41A 17/38 | 42/75.01 |
| 1,355,423 | A * | 10/1920 | Pedersen | F41A 17/38 | 42/75.01 |
| 2,248,445 | A * | 7/1941 | Wilson | F41A 3/68 | 42/16 |
| 2,664,786 | A * | 1/1954 | Guisasola | F41A 5/04 | 42/7 |

(Continued)

*Primary Examiner* — Derrick R Morgan
(74) *Attorney, Agent, or Firm* — Creativenture Law, LLC; Dennis J M Donahue, III; Kevin C. Staed

(57) ABSTRACT

A quick release pin is used in a firearm to secure a barrel assembly to a frame and a recoil assembly within a slide. The cylindrical body of the pin functions similarly to traditional takedown pins and pivot pins used with firearms while the lever arm has unique features that are an improvement over traditional takedown pins. The arm has a locking lip at its proximate end, a detent at its distal end, and a cut-out center section which is thinner than the distal end and proximal end. The cut-out center section creates a space between the arm and the firearm's side when the arm is in its locked configuration which provides side edges for a user to grasp the edges of the arm between a finger and thumb while the thicker distal end of the arm is in flush contact with the side of the firearm.

20 Claims, 5 Drawing Sheets

(56) References Cited

U.S. PATENT DOCUMENTS 3,306,168 A * 2/1967 Blumrick ..... F41A 3/38 42/75.02
3,318,192 A * 5/1967 Sullivan ..... F41A 3/26 42/106
RE26,872 E * 4/1970 Dieckmann ..... F41A 3/12 42/7
3,527,194 A * 9/1970 Desrochers ..... F41B 11/62 124/37
3,657,959 A * 4/1972 Kart ..... F41A 11/02 89/128
3,724,326 A * 4/1973 Day ..... F41A 11/02 89/196
3,745,881 A * 7/1973 Roy ..... F41A 3/64 89/163
3,857,322 A * 12/1974 Lichtman ..... F41A 3/82 89/145
4,342,169 A * 8/1982 Lichtman ..... F41A 3/38 42/11
4,563,937 A * 1/1986 White ..... F41A 3/26 42/7
4,580,484 A * 4/1986 Moore ..... F41A 3/44 42/77
4,602,450 A * 7/1986 Hoenig ..... F41A 21/487 42/75.02
4,627,184 A * 12/1986 Ruger ..... F41A 15/16 42/25
4,715,140 A * 12/1987 Rosenwald ..... F41C 27/22 42/97
4,726,136 A * 2/1988 Dornaus ..... F41A 9/53 42/7
4,893,547 A * 1/1990 Atchisson ..... F41A 3/46 89/187.01
4,914,845 A * 4/1990 Reese ..... F41A 11/02 42/40
5,216,191 A * 6/1993 Fox ..... F41A 3/12 42/70.05
5,635,663 A * 6/1997 Krieger ..... F41A 11/02 42/69.03
5,734,120 A * 3/1998 Besselink ..... F41A 3/14 89/163
6,385,892 B1 * 5/2002 Vendetti ..... F41C 27/00 42/86
7,337,571 B2 * 3/2008 McGarry ..... F41A 3/86 42/16
7,392,611 B2 * 7/2008 Curry ..... F41A 11/00 42/106
7,726,230 B1 * 6/2010 Erdem ..... F41G 1/01 42/69.02
8,539,706 B1 * 9/2013 Vieweg ..... F41A 3/82 42/1.06
8,950,100 B2 * 2/2015 Nebeker ..... F41A 3/64 42/108
D732,625 S * 6/2015 Heizer ..... F41A 3/86 D22/104
9,574,835 B2 * 2/2017 Pflaumer ..... F41A 3/62
9,739,558 B2 * 8/2017 Lee ..... F41A 21/00
9,915,485 B2 * 3/2018 Hudson, III ..... F41A 3/86
10,054,381 B1 * 8/2018 Heizer ..... F41A 3/86
10,101,107 B1 * 10/2018 Huang ..... F41A 3/66
10,126,081 B1 * 11/2018 Geissele ..... F41A 17/46
10,126,082 B2 * 11/2018 Hudson, III ..... F41A 19/12
10,132,584 B2 * 11/2018 Abbott ..... F41A 17/38
10,234,226 B1 * 3/2019 Copeland ..... F41A 17/38
2002/0116857 A1 * 8/2002 Wonisch ..... F41A 3/64 42/75.02
2004/0035286 A1 * 2/2004 Spinner ..... F41A 11/00 89/180
2005/0188592 A1 * 9/2005 Spinner ..... F41A 11/00 42/75.03
2005/0229462 A1 * 10/2005 McGarry ..... F41A 17/02 42/70.08
2005/0247187 A1 * 11/2005 McGarry ..... F41A 3/86 89/198
2005/0257413 A1 * 11/2005 Zimmermann ..... F41A 5/04 42/75.1
2006/0150466 A1 * 7/2006 Hochstrate ..... F41A 17/72 42/69.03
2007/0074443 A1 * 4/2007 La France ..... F41A 11/00 42/146
2008/0190006 A1 * 8/2008 Jenkins ..... B25B 27/04 42/90
2009/0071053 A1 * 3/2009 Thomele ..... F41A 11/02 42/1.01
2010/0319233 A1 * 12/2010 Wray ..... F41A 11/00 42/108
2011/0167704 A1 * 7/2011 Chupp ..... F41C 27/00 42/90
2011/0225862 A1 * 9/2011 Lowry ..... F41A 3/54 42/6
2011/0265639 A1 * 11/2011 Darian ..... F41A 3/38 89/191.01
2012/0180354 A1 * 7/2012 Sullivan ..... F41A 3/26 42/16
2013/0269232 A1 * 10/2013 Harris ..... F41A 9/64 42/49.01
2014/0165442 A1 * 6/2014 Nebeker ..... F41A 3/64 42/16
2014/0338243 A1 * 11/2014 La Vigne ..... F41A 35/06 42/16
2015/0276334 A1 * 10/2015 Pflaumer ..... F41A 3/62 89/191.01
2015/0316336 A1 * 11/2015 Lee ..... F41A 3/38 42/16
2015/0330736 A1 * 11/2015 Love ..... F41A 5/02 42/16
2016/0047613 A1 * 2/2016 Hudson, III ..... F41A 3/86 42/14
2016/0069628 A1 * 3/2016 Fluhr ..... F41A 17/38 42/6
2016/0116250 A1 * 4/2016 Mather ..... F41C 23/04 42/73
2016/0146559 A1 * 5/2016 Bantle ..... F41A 17/34 42/16
2016/0223276 A1 * 8/2016 Serandour ..... F41A 3/46
2016/0356568 A1 * 12/2016 Kuracina ..... F41A 19/30
2017/0176119 A1 * 6/2017 Cross ..... F41A 17/38
2017/0205163 A1 * 7/2017 Fumia ..... F41A 3/66
2017/0234639 A1 * 8/2017 Kuracina ..... F41A 17/74 89/128
2017/0268843 A1 * 9/2017 Heizer ..... F41A 19/14
2017/0321980 A1 * 11/2017 Wolf ..... F41A 19/15
2017/0321981 A1 * 11/2017 Voigt ..... F41A 11/04
2018/0031341 A1 * 2/2018 Bubits ..... F41A 3/14
2018/0045478 A1 * 2/2018 Couce ..... F41A 15/06
2018/0058788 A1 * 3/2018 Singh ..... F41A 17/70
2018/0073825 A1 * 3/2018 Zukowski ..... F41C 3/00
2018/0164058 A1 * 6/2018 Hudson, III ..... F41A 3/66
2018/0180369 A1 * 6/2018 Pappas ..... F41A 3/64
2018/0313618 A1 * 11/2018 Timmons ..... F41A 3/66

* cited by examiner

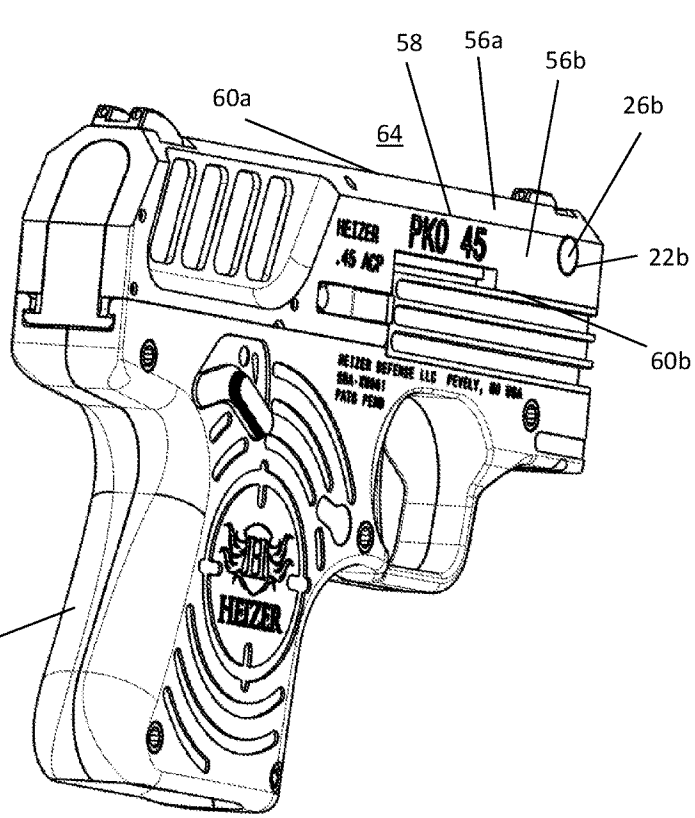
FIG. 1A
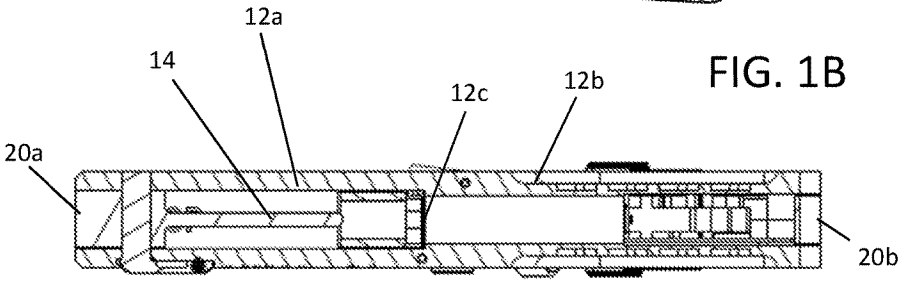
FIG. 1B
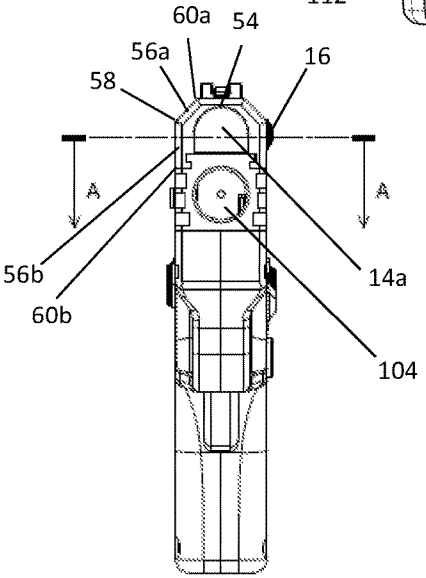
FIG. 1C
FIG. 1D

FIREARM QUICK RELEASE PIN WITH ARM EXTENSION

CROSS-REFERENCE TO RELATED APPLICATIONS

This application claims priority from U.S. Provisional Patent Application No. 62/426,965 filed Nov. 28, 2016 and is a continuation-in-part of U.S. patent application Ser. No. 15/823,100 filed on Nov. 27, 2017, and both priority applications are hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to a firearm, and more particularly to a firearm having a quick release pin that aids in the assembly and disassembly of the firearm parts.

Related Art

Firearms in general are traditionally made up of many separate assemblies that function in unison to discharge a projectile. Some of these assemblies include the trigger assembly, recoil assembly, and slide assembly. It is a known advantage to be able to separate these assemblies, or "takedown" the firearm, in order to facilitate easier cleaning and maintenance as the assemblies themselves are more accessible when disassembled. Traditional firearms use "takedown pins" or similar pins to hold these components together. Traditionally, one of the firearm components includes cutouts for receiving the lug of a corresponding component and when fit together, a pin locks the lug within the cutout. When the firearm is assembled, the pin extends between the sides of the frame and is flush with the frame on each end. To remove these pins, a punch or other tool is needed as the flush pin does not provide any handle or knob that allow it to be pulled out. Accordingly, there has been a long desire in the art to provide a means for easier and quicker takedown absent additional tools like a punch. Therefore, it is an object of the slide assembly quick release pin and arm to provide such an improvement wherein a slide assembly may be quickly assembled or disassembled without additional tools.

There have been previous attempts to facilitate quicker takedown by providing a larger area for gripping of takedown pins or a variety of textures and patterns, including grooves and dimples, on an end of the pin to increase purchase. For example, previously known improvements can be seen in U.S. Pat. No. 9,151,555 and the Demon Tactical Quick Pin (www.gunblast.com/Demon.htm). The '555 Patent particularly discloses a flat portion on the pin head, intended to allow a user to grip the flat portion and pull out the pin without additional tools. Similarly, the Demon Tactical Quick Pin uses a rotating locking lever which is similar to the quick-release locking pins disclosed in U.S. Pat. Nos. 3,192,820 and 9,297,401. This lever rests perpendicular to the pin against the firearm frame and rotates away from the frame of the firearm to enable pulling. These improved pins provide an extension on the same longitudinal axis of the pin that a user may grasp to pull the pin out of its aperture. However, these prior art references neither provide leverage for rotating the pin around its longitudinal axis to break static friction nor provide a fixed surface that is perpendicular to the pin's longitudinal axis and extends from the head of the pin by more than a pin diameter. Accordingly, there still is still a need for a takedown pin that increases gripping ability while also providing leverage for rotating the pin to break the static friction while pulling the pin out. In addition, these known pins are not easily adapted to positions on the slide assembly of a firearm.

Some of the takedown pins and pivot pins described in U.S. Pat. No. 9,243,857 have a lever arm that is fixed to the pin body portion rather than being rotatable relative to the pin body as in the '401 Patent. Although the pins disclosed in the '857 Patent are not adapted for use with a slide mechanism, the lever arm of this pin increases the gripping ability while also providing leverage for rotating the pin to break the static friction while pulling the pin out. However, according to the particular teaching of the '857 Patent, the lever arm is spaced from the pin body by a pin head which results in the lever arm being spaced away from the side of the firearm rather than being in flush contact with the side of the firearm. The space between the lever arm and the firearm's side provides side edges for a user to grasp the lever arm between a finger and thumb, but since the distal end of the lever arm is not flush against the firearm's frame, it can get caught on the user's clothing, a holster, or other things in the environment, such as branches, which can result in the inadvertent rotation and possible pulling of the pin. Accordingly, there remains the need for improvements to firearm pins with a lever arm that is fixed to the body in a way that will keep the end of the arm in flush contact with the side of the firearm and can lock the pin in place to prevent its inadvertent rotation and removal.

SUMMARY OF THE INVENTION

Embodiments of the present invention comprise a firearm having a slide and a recoil mechanism that includes a recoil spring and a recoil rod, where the recoil mechanism is positioned above the barrel and generally within the slide of the firearm, collectively forming a slide assembly. The slide assembly has an assembled configuration when the recoil assembly is secured within the slide by the quick release pin. In this configuration, the pin is inserted through a pair of apertures in a front portion of the slide and through a bore in the nose portion of the recoil rod aligned between the apertures. As the pin secures the recoil assembly within the slide, an arm attached to the end of the pin rests in a recess flush to the body of the slide in a locked position.

Additional embodiments of the present invention are described and shown with one or more pins being used to secure the barrel assembly to the frame of the firearm. The pin is inserted through a pair of apertures in the side of the firearm frame and through a bore in a mount for the barrel assembly. As with the pin used in the recoil assembly, the pin connecting the barrel assembly to the frame is in flush contact with the side of the frame when the lever arm is in its locked position. The pin preferably includes a locking lip at the proximate end of the arm, a detent at the distal end of the arm, and a cut-out center section which is thinner than the distal end and proximal end of the arm and is situated between the locking lip and the detent. The cut-out center section allows the arm to flex slightly as it is moved into its locked position with the locking lip fitting into a slot in the side of the firearm and the detent being held against a dimple in the firearm's side face.

The slide assembly and barrel assembly also have disassembled configurations where the pin is removed from the apertures and bore which allow the recoil assembly to come free from the slide and allow the barrel assembly to be separated from the frame. It is an aspect of the present invention that the pin arm is rotated from its locked position in flush contact with the firearm's side in the assembled configuration to an unlocked position with the distal end out of contact with the firearm's side before the pin body is removed from the apertures and the bore so that the firearm can be disassembled. The pin arm acts as a handle for grasping and rotating which provides a mechanical advantage when a user is removing or inserting the pin into the apertures and bore, as the rotation helps to combat the effects of friction. Additionally, this mechanical advantage allows a user to assemble and disassemble the firearm without other tools. The cut-out center section also creates a space between the lever arm and the firearm's side when the arm is in its locked configuration which provides side edges for a user to grasp the edges of the lever arm between a finger and thumb while the thicker distal end of the arm is in flush contact with the side of the firearm when in the locked position.

Further areas of applicability of the present invention will become apparent from the detailed description provided hereinafter. The detailed description and specific examples of the invention in the specification and drawings are intended for purposes of illustration only and are not intended to limit the scope of the invention.

BRIEF DESCRIPTION OF THE DRAWINGS

The present invention will become more fully understood from the accompanying drawings.

FIGS. 1A and 1B are perspective views of a semi-automatic firearm with a slide assembly quick release pin.

FIGS. 1C and 1D are a front view and a top view, respectively, of the firearm shown in FIGS. 1A and 1B.

DETAILED DESCRIPTION OF THE PREFERRED EMBODIMENTS

Figures 2A, 2B:
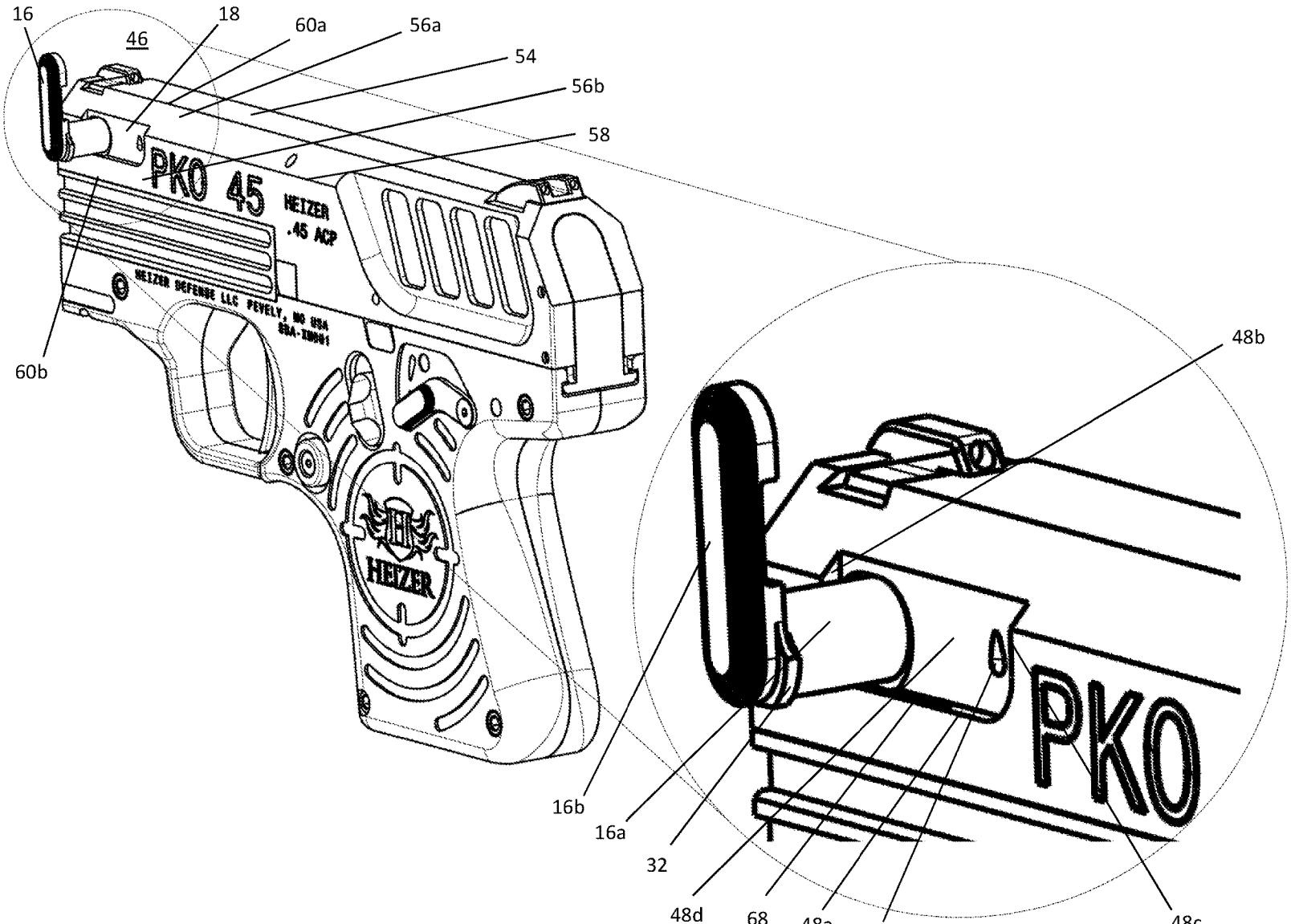
FIGS. 2A and 2B are a perspective view and detail view, respectively, of a partially inserted quick release pin.

The following description of the preferred embodiment(s) is merely exemplary in nature and is in no way intended to limit the invention, its application, or uses. Generally, as shown in FIGS. 1-4, the firearm 100 of the present invention includes a frame 102, a barrel assembly 104, 110 and a slide assembly 10. The slide assembly has a casing 12 that houses a recoil assembly 14. The slide and recoil assemblies can be located above the gun barrel so that the barrel is situated between the topmost part of the frame and the bottom of the slide assembly or the slide and recoil assemblies may be located between the barrel and the frame as in most semi-automatic pistol configurations. The barrel assembly includes a barrel bore 104*a*, a barrel body 104*b*, and a housing 104*c* which is attached to the barrel body. The housing is covered by the slide assembly and secures one side of the recoil assembly. The barrel assembly can be removably connected to the frame through front 106*a* and rear mounts 106*b* that may be secured using removable pins 108. The firearm is operated by the firing system which includes a trigger assembly 110 (not shown in detail) and a linear striker assembly (not shown in detail).

The slide assembly of the present invention includes a casing, a quick release pin 16, and an external recess 18 on the front portion of the casing. The slide assembly has an assembled configuration 64 and a disassembled configuration 66. The recoil assembly is mounted within the casing and generally includes a recoil spring 14*c* situated around a recoil rod 14*b* with one end of the spring pressed against a nose portion 14*a*. The recoil assembly also preferably includes a sleeve 14*d* that is secured within the housing in the barrel assembly; the other end of the spring is situated within the sleeve and the side of the rod opposite from the nose portion passes through an aperture in the back of the sleeve. In the assembled configuration the quick release locking pin secures the recoil assembly within the slide. Conversely, when the quick release pin is removed, the recoil assembly is free from the slide in the disassembled configuration. According to the present invention and described in detail below, the release pin includes a lever arm 16*b* that extends perpendicularly from the cylindrical body 16*a* of the pin at one end of the body and may also include a locking lip 32 at the proximate end of the arm where it is attached to the body, a detent 38 at the distal end of the arm, and a flexible thinner center section 34 between the proximate and distal ends.

The casing is generally separated into a front casing 12*a* and a rear casing 12*b*. The front casing extends from the internal recess 12*c* within the casing to a distal end 20*a* around a nose portion of the recoil assembly. Conversely, the rear casing extends in the opposite direction from the internal recess towards the butt end 20*b* of the casing and firearm. The front casing has a pair of circular apertures 22*a* & 22*b* at the distal end. In the assembled configuration the recoil assembly is housed within the front casing and is secured therein by the quick release pin described below. The recoil assembly is comprised of the nose portion having an elongated rod extending within the casing from the nose portion towards the internal recess. The nose portion of the recoil assembly also has a cylindrical bore 24 that is aligned between the apertures in the assembled configuration. Accordingly, the recoil assembly is secured within the slide when the body of the quick release pin extends through the pair of apertures in the front casing and through the bore in the nose portion.

When the recoil assembly is secured within the casing by the quick release pin, as shown in FIGS. 1A and 1B, the pin body fully extends between apertures and the bore with the proximal end of the pin 26*a* flush with the side wall of the firearm in the external recesses and the distal end of the pin 26*b* flush with the opposite side wall of the firearm. The pin's cylindrical body has a friction fit within the cylindrical bore. As explained in detail below, the pin body's proximal end is attached to the pin arm's proximal end which is seated within the external recess in the locked orientation when the firearm is in the assembled configuration. In the preferred embodiment, the front casing slidingly engages the topmost portion of the barrel and encloses the recoil assembly within an interior space 62 of the front casing, above the top of the barrel. Further, the rear casing slidingly engages a handle assembly 112 of the firearm proximate to the butt end which may house or be in operable connection with any number of other assemblies commonly seen in firearms such as the trigger assembly.

In the preferred embodiment the casing has a top side 54 and a pair of angled side walls 56 as shown in the figures and particularly shown in the FIG. 1C and FIG. 2A. The side walls extend from an edge 60*a* of the topside to a bend 58 separating the side walls into two sections. The top section 56*a* of the side wall is located above the bend and slopes away from the bottom section of the side wall to the edge of the top side. Conversely, the bottom section of the side wall 56*b* is vertical and arranged perpendicular to the horizontal top side and connected thereto between the top section of the side wall at the bend an a bottom edge 60*b* proximate to the barrel assembly. Additionally, the pair of apertures are cut from the bottom section proximate to the bend with at least one of the apertures 22*a* positioned within an external recess as described below and shown in FIGS. 1B and 3A. Accordingly, an external recess is on the outside of the casing and extends horizontally from at least one of the apertures towards the rear casing. In another embodiment not shown in the figures, the casing has an inverted "U" shape with the side walls being perpendicular to the top side without any bend separating the side walls into two sections. In this embodiment the apertures are proximate to the meeting point of the top side and sidewalls, with the external recess again extending along one of the side walls from at least one of the apertures towards the rear casing.

Figures 3A, 3B:
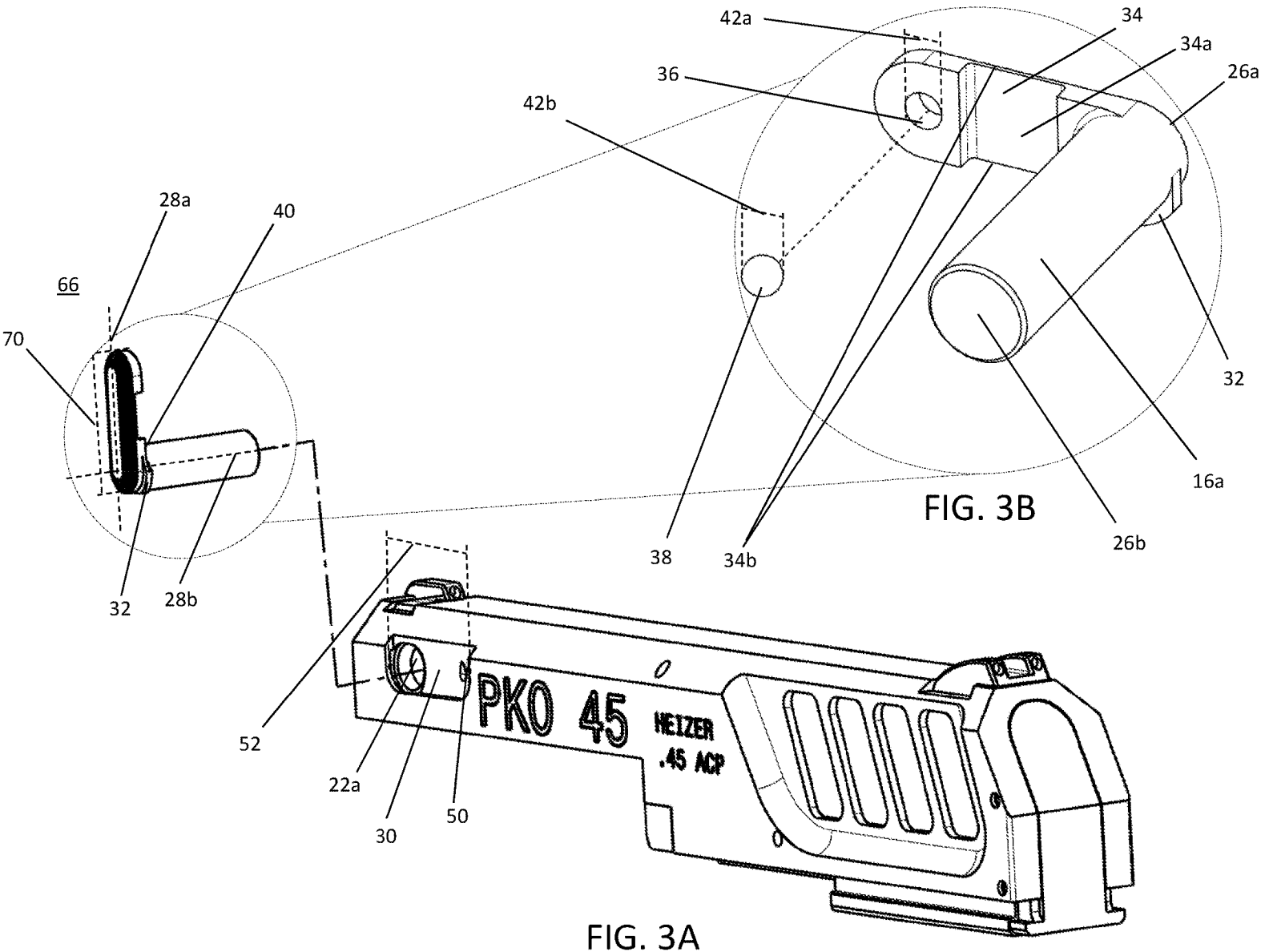
FIGS. 3A and 3B are detail views of the quick release pin according to the present invention.

Another aspect of the present invention shown in FIGS. 2B and 3A is the external recess along a side wall of the front casing. In the preferred embodiment, the external recess 18 is set back from the side wall of the firearm to a recessed face 48*d*. The recessed face is defined by three edges, namely a front edge 48*b* towards the barrel end of the firearm, a back edge 48*c* towards the butt end of the firearm, and a bottom edge 48*a* connecting the front edge to the back edge. As it is an aspect of the pin arm to rotate in and out of the external recess while the pin body extends through the apertures in the side walls and bore, one of the side wall apertures is positioned within the external recess proximate to the front edge and the external recess is open to the top side.

The recessed face is open to the top side, and the recessed width's distance 52 as measured between the front and back edge of the external recess is greater than the length of the pin arm 70. In the preferred embodiment, the slide assembly has a single external recess with one of the pair of apertures cut within the recessed face, proximate to the front edge. Further, there is a dimple 50 within the recessed face proximate to the back edge and separated from the aperture. The ball detent particularly described below is seated within the dimple and prevents unintended rotation of the pin out of the external recess. Additionally, the bottom edge of the recessed face has a slot 68*a* that prevents the pin arm from sliding out of the recess and aperture. The slot is cut into the bottom edge, and the locking lip 32 fits within the slot in the locked orientation. Accordingly, the pin arm is secured within the recess in the locked orientation by the ball detent and locking lip. Additionally, a front face of the pin arm is flush with the side wall of the firearm, as shown in FIG. 1.

As depicted in FIGS. 2 and 3, the quick release pin has a pin body that extends through the pair of apertures in the front casing and the bore in the nose of the recoil assembly. Additionally, the quick release pin is made up of a pin arm attached perpendicular to the proximal end of the pin body such that the longitudinal axis of the pin arm 28*a* is substantially perpendicular to the longitudinal axis of the pin body 28*b*. The pin arm is made up of the features shown in FIG. 3B which include the locking lip, flex cut-out center section 34, and ball detent. The locking lip extends from the bottom edge of the pin arm 40 proximate to the pin body in a direction that is laterally away from the longitudinal axis of the pin arm, i.e., in a plane that is perpendicular to the longitudinal axis of the pin's cylindrical body. On the opposite end of the pin arm from pin body and locking lip is a ball detent secured within a cavity 36 in the pin arm by at least one of a friction fit and an interference fit. Regardless of whether a friction fit or an interference fit is used, the cavity has a cavity diameter 42*a* and the ball detent has a ball detent diameter 42*b*. In a friction fit arrangement the ball detent diameter is approximately equal to the cavity diameter. Conversely, when the ball detent is secured within the cavity by the interference fit the ball detent diameter is greater than the cavity diameter.

Accordingly, the pin arm has a locked orientation 44 in the assembled configuration and an unlocked orientation 46 in the disassembled configuration. When locked, the pin arm is rotated into the external recess against the exterior of the front casing 30 and the longitudinal axis of the pin arm is parallel to the bottom edge of the external recess. In this position, the locking lip of the pin arm extends into the slot in the bottom edge of the recess and the pin body may not be pulled out without the locking lip first being rotated out of the slot. To prevent unintended rotation, the ball detent locks within the dimple in the recessed face. As the ball detent protrudes perpendicularly from the pin arm, it rubs against the recessed face and friction is created as it rotates into the locked orientation and is seated in the dimple. To prevent wear and deterioration on the ball detent and recessed face, the pin arm has a flex cut-out between its connection at the pin body and the ball detent, which acts as a spring. During this rotation, the flex cut-out allows the pin arm and ball detent to bend away from the recessed face to prevent unwanted wear.

The ball detent is separated from the pin body by the flex cut-out center section which acts as a spring when the pin arm is rotated between the locked and unlocked orientations. When the firearm is assembled and the quick release pin is in the locked orientation the pin body extends through the apertures and the bore while the locking lip and ball detent secure the pin arm within the external recess where the locking lip is seated within the slot and the ball detent is seated within the dimple. In operation the cut-out in the pin arm allows the pin arm to flex during rotation as the ball detent moves in and out of the dimple in the recessed face of the external recess. Without the cut-out, the pin may still rotate between the two orientations but the flexing motion of the pin arm allows the ball-detent to more easily move in and out of the dimple and the side walls may tend to deteriorate more quickly from the friction between the side wall and ball detent during rotation. Additionally, the flexing motion provides leverage as the user can flex the pin arm away from the side wall of the firearm to gain more purchase on the pin arm during rotation.

Conversely, the pin arm is rotated out of the external recess in the unlocked orientation and is removed from the recessed face as shown in FIGS. 2 and 3A. In the preferred embodiment the pin arm rotates to a position removed from the recessed face as the sloped top section of the side wall extends away from the plane on which the pin arm rotates. In another embodiment the pin arm rotates to a position above the top side of the inverted "U" shaped casing where there is no portion of the casing behind the pin arm. Regardless of the embodiment, there is nothing behind the pin arm in the unlocked orientation and a user may slide their finger behind the pin arm and pull the pin body out of the apertures and bore. Additionally, the rotation of the pin body within the apertures and bore caused by the rotation of the pin arm breaks the static friction of the cylindrical body within the cylindrical bore and facilitates easier removal of the pin body from the apertures and bore.

Additionally, it should be appreciated that the pin of the present invention is not limited to use in any one position. The preferred embodiment described herein describes a pin used in a semi-automatic pistol that connects the recoil assembly to the slide assembly. However, the quick release pin may be used in other embodiments separate from the slide assembly, such as in the positions of traditional takedown and pivot pins 108 shown in FIG. 4. The pin of the present invention is not intended for the limited use in a conventional firearm having a rear takedown pin and pivot pin but instead may be used in all types of firearms, conventional or otherwise, including in a slide assembly that secures the recoil assembly within the slide. Accordingly, the quick release pin may function to hold other firearm components together, and although an external recess for the arm of the pin is preferred, the recess is not necessary.

Figure 4:
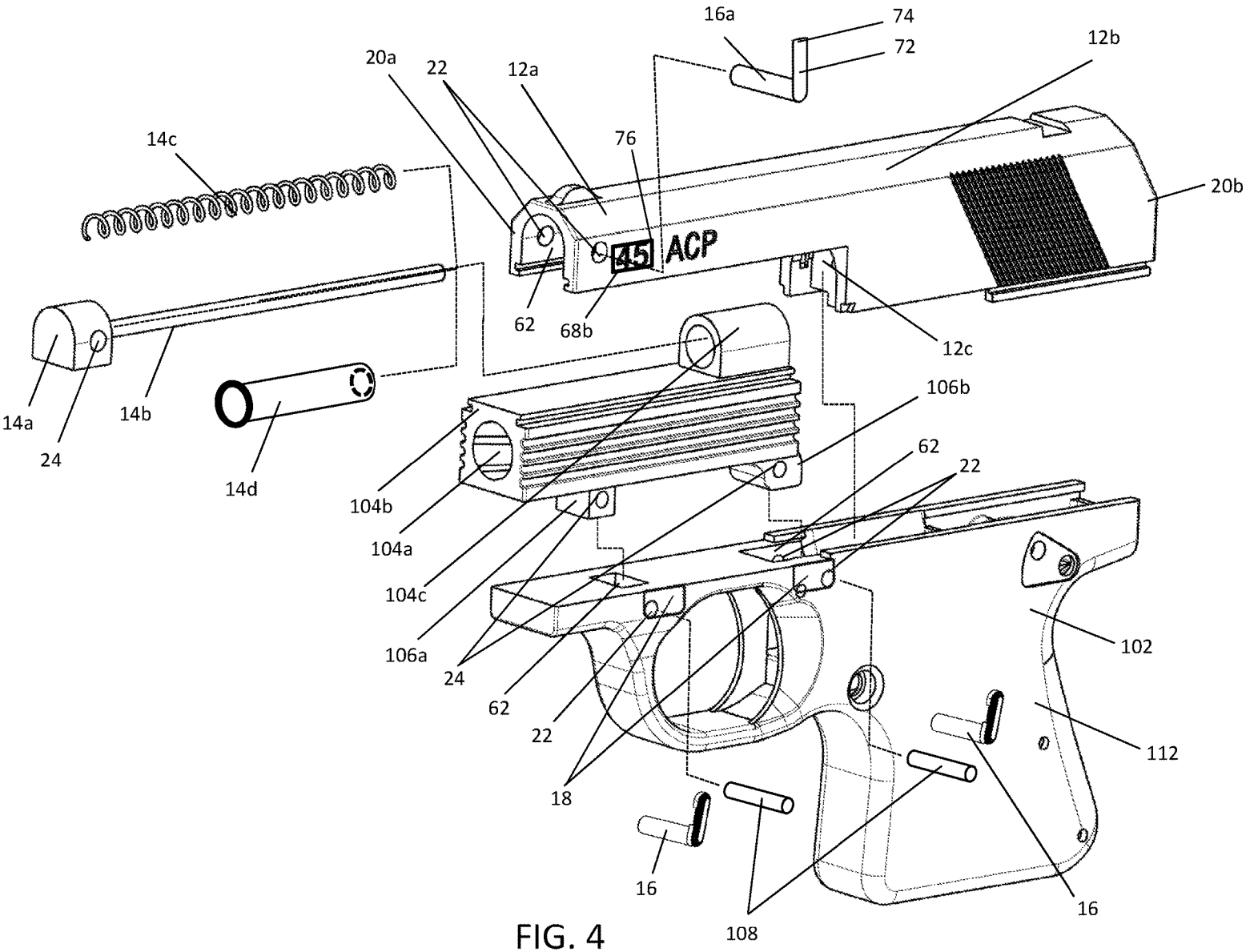
FIG. 4 is an exploded view of a semi-automatic firearm with a quick release pin used for the slide assembly and with quick release pins optionally used for the barrel assembly.

FIG. 4 illustrates an example of the present invention in which a portion of the arm of the pin is held in an alternative slot 68*b* that extends outwardly from the sidewall of the casing. Preferably, the center section 72 of the arm is held by a friction fit within the slot, and the distal end of the arm 74 extends out from the slot's end 76. Accordingly, in this embodiment, there is no need for a lip or a detent at the end of the arm. It is preferred for the arm to extend flush along the sidewall of the firearm, which for most applications will have the arm being aligned with and adjacent to the sidewall and perpendicular to the body.

As shown in FIG. 4, the quick release pins 16 of the present invention can be used to replace traditional takedown pins 108 that are used to hold the barrel assembly to the frame or to hold other structures to the frame or the barrel. Similar to the quick release pin 16 used in the slide assembly, the quick release pins 16 for the barrel assembly extend through apertures 22 on opposite sides of the frame and through bores 24 in the front 106*a* and rear mounts 106*b* of the barrel assembly. The mounts are situated in interior spaces 62 of the frame. Accordingly, FIG. 4 illustrates how the pins can be used to connect the mount for the barrel assembly within the frame's interior space. It will be appreciated that this same type of connection using the quick release pins of the present invention can be used with upper and lower receivers. Similar to the housing of the slide assembly, the frame can also include recesses 18 in which the arms of the pins rotate, or the frame could have slots for the arms. As with the slide assembly, the recess in the side of the frame can have a slot in which a locking lip fits and may also have a dimple in which the ball detent is situated to lock the quick release pins.

Figure 5:
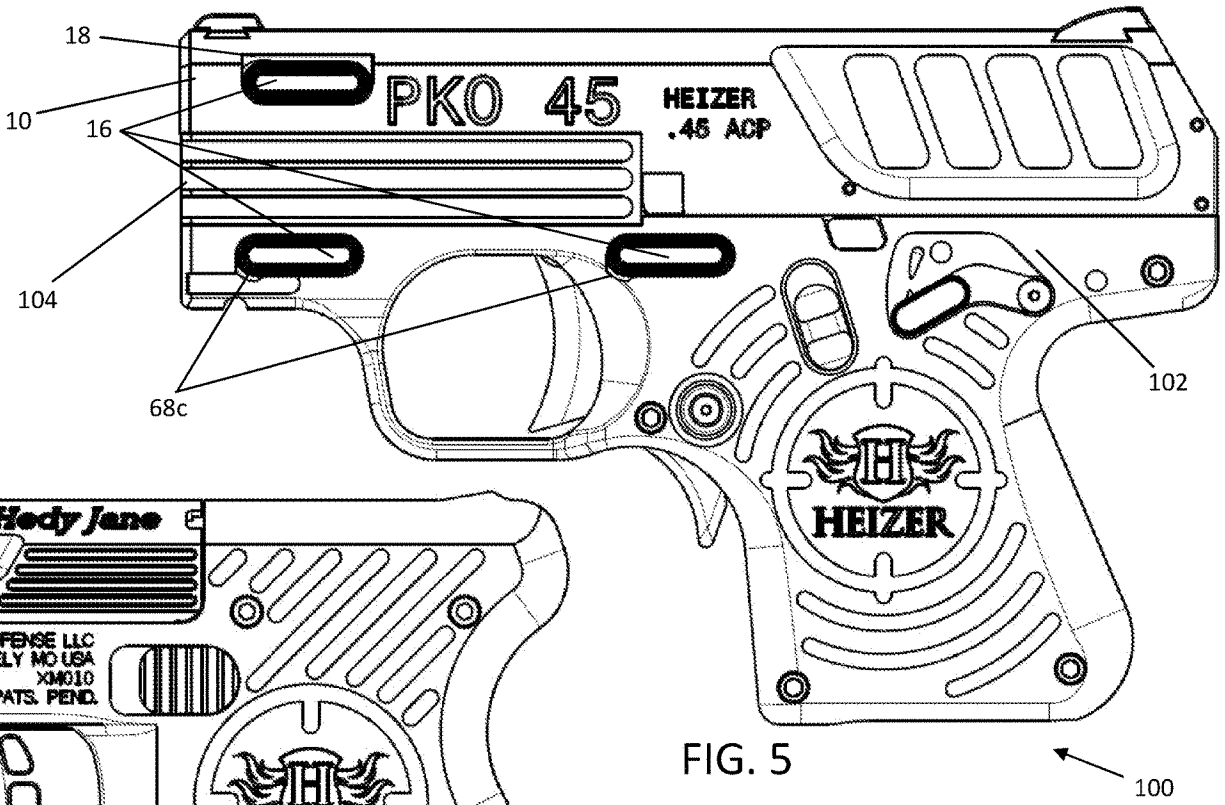
FIG. 5 is a side view of a semi-automatic firearm with quick release pins used for the slide assembly and for the barrel assembly.
Figure 6:
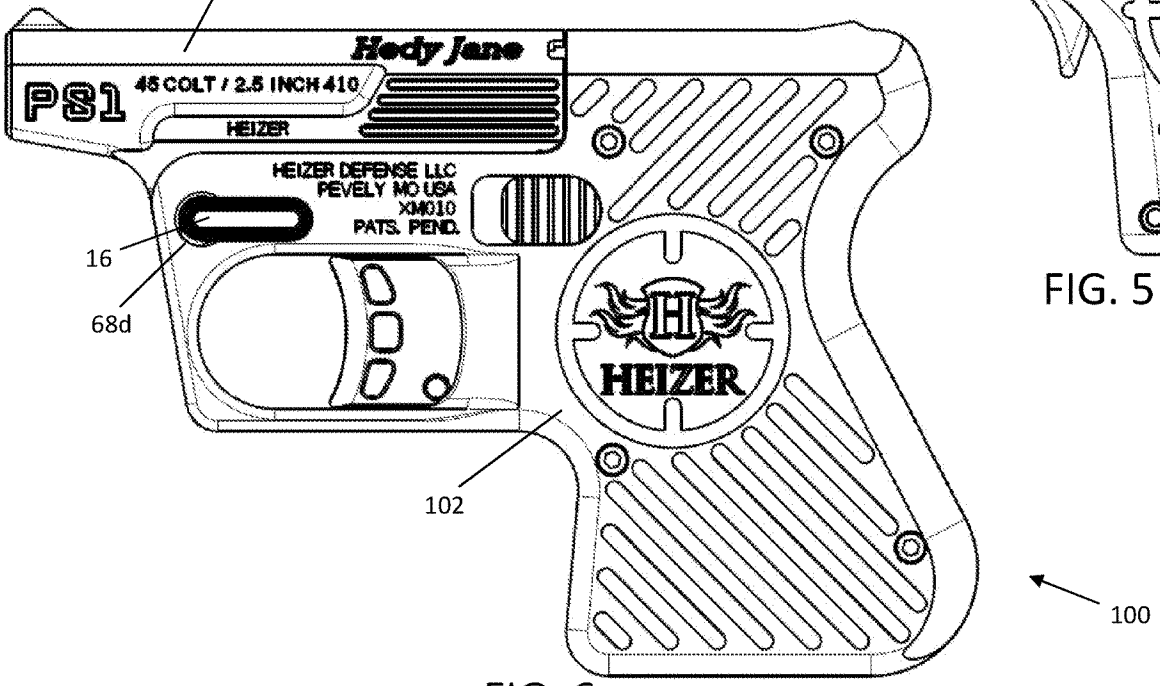
FIG. 6 is a side view of a firearm with a quick release pin used with a barrel.

Similar to the pin in the slide assembly, the quick release pins in the frame are positioned in flush contact against the side of the frame when in the locked position. When the arms of the pins are in their locked positions, they may be situated in recesses 18 as shown in FIGS. 1 and 5 or situated on a flat face of the firearm (without any recess) as shown in FIGS. 5 and 6. According to the embodiment shown in FIG. 5, the quick release pins that are situated on a flat face can still have a locking lip that fits in a small slot 68*c* formed near the aperture in the frame. Additionally, as shown in FIG. 6, the slot 68*d* can be positioned in a countersunk recessed portion of the frame around the aperture. The cut-out center section of the lever arm in the pins of the present invention coupled with the flush contact between the distal end of the arm and the side of the firearm is an improvement over previously known takedown pins with lever arms with the distal end that is spaced from the side. The cut-out center section 34 creates a space 34*a* between the lever arm and the firearm's side when the arm is in its locked configuration which provides side edges 34*b* for a user to grasp the edges of the lever arm between a finger and thumb while the thicker distal end of the arm is in flush contact with the side of the firearm when in the locked position.

The embodiment in FIG. 6 shows a derringer style firearm in which the barrel is rotatably connected to the frame through the quick release pin. As with the semi-automatic firearms described above, the quick release pin extends through the apertures on opposite sides of the frame and through a bore in the barrel's front mount. As illustrated in U.S. Pat. Nos. 9,103,626 and 10,001,333 which are hereby incorporated by reference in the present invention, the rear mount for the derringer style firearm is preferably formed by a latch and catch arrangement. It will be appreciated that the quick release pin of the present invention can be used wherever a traditional takedown pin is used, such as connecting the barrel of a rifle or a shotgun to the firearm's frame.

In operation, it is an aspect of the quick release pin is to provide an easier means to remove and insert the pin into the aperture and subsequently assemble a firearm. The pin body acts to secure the components but the improvement is achieved by the pin arm. The pin arm acts as a handle for a user by providing a larger area for grasping which more easily allows the pin to be pulled or pushed in and out of the apertures. Beyond the larger area for increased purchase, the pin arm being perpendicularly fixed provides a mechanical advantage as a user may pull from a different longitudinal axis than the pin body. Such a configuration allows a user to hook the pin arm from behind rather than simply grasping it as an extension of the pin body. Accordingly, the handle eliminates the need for a tool previously needed to punch the pin out when in the assembled configuration. In addition to being a handle for pulling, the pin arm also rotates from the locked orientation within the external recess to the unlocked orientation removed from the recessed face. The rotation of the pin body, via the pin handle, creates a mechanical advantage as the initial static friction is overcome, which facilitates easier removal of the pin body from the apertures and bore. Similarly, the pin arm provides a mechanical advantage during assembly when the pin body is being inserted through the apertures and bore as it may again be rotated to combat friction.

It will also be appreciated that the innovative locking lip seated in the slot prevents the pin from being shook loose and vibrated out of the bore in the nose portion of the recoil assembly and the apertures in the front casing when the gun is repeatedly fired. The ball detent prevents the distal end of the arm from rotating out of its locked orientation when the locking lip is seated in the slot. The flex in the center portion of the arm provides a spring mechanism to the arm in which the detent is forced into the dimple in the sidewall of the recess and is allowed to bend slightly outwardly when a user forces the arm to rotate upward out of the recess in the slide.

The embodiments were chosen and described to best explain the principles of the invention and its practical application. As various modifications could be made to the exemplary embodiments, as described above with reference to the corresponding illustrations, without departing from the scope of the invention as understood by persons of ordinary skill in the art, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A firearm for shooting ammunition, comprising:

a frame comprising a pair of sides, an interior space within the frame between the sides, a pair of apertures extending from an exterior of the frame through the respective pair of sides to the interior space, and a recess in the exterior of the frame, a slot proximate to one of the pair of apertures in the recess at the exterior of the frame;

a barrel assembly, a mount connecting the barrel assembly to the frame, wherein the mount is positioned within the interior space of the frame and comprises a bore, and wherein the bore is aligned with the apertures in the sides of the frame; and a first pin fixedly locking the mount to the frame, wherein the first pin is comprised of a cylindrical body and a lever arm with a locked orientation and an unlocked orientation, wherein a proximal end of the lever arm is fixedly attached to a first end of the cylindrical body, wherein the cylindrical body has a first longitudinal axis and the lever arm has a second longitudinal axis that is askew from the first longitudinal axis, wherein the cylindrical body extends through the apertures and the bore to a second end, wherein a distal end of the lever arm is in flush contact with the exterior of the frame when the lever arm is in the locked orientation, wherein the lever arm is comprised of a locking lip at its proximal end, wherein the locking lip extends away from the cylindrical body in a plane perpendicular to the first longitudinal axis of the cylindrical body, wherein the locking lip fits within the slot in the recess at the exterior of the frame in the locked orientation, and wherein the locking lip is rotated out of the slot in the unlocked orientation.

2. The firearm of claim 1, wherein the lever arm is situated in the recess in the locked orientation.

3. The firearm of claim 1, wherein the lever arm is comprised of a cut-out center section situated between the proximal end and the distal end of the lever arm and forming a space in the lever arm extending between a pair of side edges, wherein the proximal end of the lever arm is in flush contact with the exterior of the frame when the lever arm is in the locked orientation, and wherein the cut-out center section of the lever arm between the pair of side edges is spaced away from the exterior of the frame when the lever arm is in the locked orientation.

4. The firearm of claim 1, wherein the distal end of the lever arm is further comprised of a cavity and a ball detent, wherein the ball detent is secured within the cavity by at least one of a friction fit and an interference fit, wherein the recess in the frame is further comprised of a dimple, and wherein the ball detent is situated in the dimple when the lever arm is in the locked orientation.

5. The firearm of claim 1, wherein the barrel assembly is further comprised of a barrel bore, a barrel body, and a housing attached to the barrel body, and wherein the second longitudinal axis of the lever arm is substantially perpendicular to the first longitudinal axis of the cylindrical body.

6. The firearm of claim 5, further comprising a slide assembly, a recoil assembly within the slide assembly, and a second pin holding the recoil assembly within the slide assembly, wherein the slide assembly is comprised of a front casing slidingly engaged with the barrel body and a rear casing slidingly engaged with the frame, wherein the front casing further comprises a pair of apertures and an internal recess, wherein the recoil assembly is mounted within the front casing and is comprised of a recoil rod with a nose portion at one end, a sleeve mounted within the housing in the barrel assembly, and a recoil spring around the recoil rod with a first end of the spring pressed against the nose portion and a second end of the spring contained in the sleeve, wherein the nose portion is comprised of a cylindrical bore situated between the pair of circular apertures in the front casing, wherein the second pin is comprised of a pin body and a pin arm with a locked position and an unlocked position, wherein a proximal end of the pin arm is fixedly attached to a first end of the pin body, wherein the pin body has a first longitudinal axis and the pin arm has a second longitudinal axis that is substantially perpendicular to the first longitudinal axis, wherein the pin body extends through the circular apertures and the cylindrical bore to a second end, and wherein a distal end of the pin arm is in flush contact with an exterior side of the front casing when the pin arm is in the locked position.

7. The firearm of claim 6, wherein the pin arm is comprised of at least one of a lip and a cut-out center section, wherein the lip is located at the proximal end of the pin arm, wherein the lip extends away from the pin body in a plane perpendicular to the first longitudinal axis of the pin body, wherein the front casing is further comprised of a slot proximate to one of the pair of apertures, wherein the lip fits within the slot in the locked position, and wherein the lip is rotated out of the slot in the unlocked position, wherein the cut-out center section is situated between the proximal end and the distal end of the pin arm, wherein the proximal end of the pin arm is in flush contact with the exterior side of the front casing when the pin arm is in the locked position, and wherein the cut-out center section of the pin arm is spaced away from the exterior side of the front casing when the pin arm is in the locked position.

8. A firearm for shooting ammunition, comprising:

a frame comprising a pair of sides, an interior space within the frame between the sides, and a pair of apertures extending from an exterior of the frame through the respective pair of sides to the interior space;

a barrel assembly, a mount connecting the barrel assembly to the frame, wherein the mount is positioned within the interior space of the frame and comprises a bore, and wherein the bore is aligned with the apertures in the sides of the frame; and a first pin fixedly locking the mount to the frame, wherein the first pin is comprised of a cylindrical body and a lever arm with a locked orientation and an unlocked orientation, wherein a proximal end of the lever arm is fixedly attached to a first end of the cylindrical body, wherein a distal end of the lever arm is in flush contact with the exterior of the frame when the lever arm is in the locked orientation, wherein the cylindrical body has a first longitudinal axis and the lever arm has a second longitudinal axis that is askew from the first longitudinal axis, wherein the cylindrical body extends through the apertures and the bore to a second end, wherein the lever arm is comprised of a cut-out center section situated between the proximal end and the distal end of the lever arm, and forming a space in the lever arm extending between a pair of side edges, and wherein the cut-out center section of the lever arm between the pair of side edges is spaced away from the exterior of the frame when the lever arm is in the locked orientation, and wherein the distal end of the lever arm flexes relative to the proximal end of the lever arm through the cut-out center section.

9. The firearm of claim 8, wherein the lever arm is comprised of a locking lip at its proximal end, wherein the locking lip extends away from the cylindrical body in a plane perpendicular to the first longitudinal axis of the cylindrical body, wherein the frame is further comprised of a slot at the exterior of one of the sides and proximate to one of the pair of apertures, wherein the locking lip fits within the slot in the locked orientation, and wherein the locking lip is rotated out of the slot in the unlocked orientation.

10. The firearm of claim 9, wherein the proximal end of the lever arm is in flush contact with the exterior of the frame when the lever arm is in the locked orientation.

11. The firearm of claim 8, wherein the distal end of the lever arm is further comprised of a cavity and a ball detent, wherein the ball detent is secured within the cavity by at least one of a friction fit and an interference fit, wherein the exterior of the frame is further comprised of a dimple, and wherein the ball detent is situated in the dimple when the lever arm is in the locked orientation.

12. The firearm of claim 11, wherein the exterior of the frame is further comprised of a recess proximate to one of the pair of apertures, wherein the dimple is situated in the recess, and wherein the lever arm is situated in the recess in the locked orientation.

13. The firearm of claim 8, further comprising a slide assembly, a recoil assembly within the slide assembly, and a second pin holding the recoil assembly within the slide assembly, wherein the slide assembly is comprised of a front casing slidingly engaged with the barrel assembly and a rear casing slidingly engaged with the frame, wherein the front casing further comprises a pair of apertures and an internal recess, wherein the recoil assembly is mounted within the front casing and is comprised of a recoil rod with a nose portion at one end, a sleeve mounted within the housing in the barrel assembly, and a recoil spring around the recoil rod with a first end of the spring pressed against the nose portion and a second end of the spring contained in the sleeve, wherein the nose portion is comprised of a cylindrical bore situated between the pair of circular apertures in the front casing, wherein the second pin is comprised of a pin body and a pin arm with a locked position and an unlocked position, wherein a proximal end of the pin arm is fixedly attached to a first end of the pin body, wherein the pin body has a first longitudinal axis and the pin arm has a second longitudinal axis that is substantially perpendicular to the first longitudinal axis, wherein the pin body extends through the circular apertures and the cylindrical bore to a second end, and wherein a distal end of the pin arm is in flush contact with an exterior side of the front casing when the pin arm is in the locked position.

14. A firearm for shooting ammunition, comprising:

a frame comprising a pair of sides, an interior space within the frame between the sides, a pair of apertures extending from an exterior of the frame through the respective pair of sides to the interior space, and a slot at the exterior of one of the sides and proximate to one of the pair of apertures;

a barrel assembly, a mount connecting the barrel assembly to the frame, wherein the mount is positioned within the interior space of the frame and comprises a bore, and wherein the bore is aligned with the apertures in the sides of the frame; and a first pin fixedly locking the mount to the frame, wherein the first pin is comprised of a cylindrical body and a lever arm with a locked orientation and an unlocked orientation, wherein a proximal end of the lever arm is fixedly attached to a first end of the cylindrical body, wherein the cylindrical body has a first longitudinal axis and the lever arm has a second longitudinal axis that is askew from the first longitudinal axis, wherein the cylindrical body extends through the apertures and the bore to a second end, wherein the lever arm is comprised of a locking lip at its proximal end, wherein the locking lip extends away from the cylindrical body in a plane perpendicular to the first longitudinal axis of the cylindrical body, wherein the locking lip fits within the slot in the locked orientation, and wherein the locking lip is rotated out of the slot in the unlocked orientation.

15. The firearm of claim 14, wherein the lever arm is comprised of a cut-out center section situated between the proximal end and the distal end of the lever arm and forming a space in the lever arm extending between a pair of side edges, wherein the proximal end of the lever arm is in flush contact with the exterior of the frame when the lever arm is in the locked orientation, and wherein the cut-out center section of the lever arm is spaced away from the exterior of the frame when the lever arm is in the locked orientation.

16. The firearm of claim 14, wherein the plane of the locking lip is on the exterior one of the sides of the frame when the lever arm is in the locked orientation.

17. The firearm of claim 16, wherein the proximal end of the lever arm is in flush contact with the exterior of the frame when the lever arm is in the locked orientation.

18. The firearm of claim 14, wherein the distal end of the lever arm is further comprised of a cavity and a ball detent, wherein the ball detent is secured within the cavity by at least one of a friction fit and an interference fit, wherein the exterior of the frame is further comprised of a dimple, and wherein the ball detent is situated in the dimple when the lever arm is in the locked orientation.

19. The firearm of claim 18, wherein the exterior of the frame is further comprised of a recess proximate to one of the pair of apertures, wherein the dimple is situated in the recess, and wherein the lever arm is situated in the recess in the locked orientation.

20. The firearm of claim 14, further comprising a slide assembly, a recoil assembly within the slide assembly, and a second pin holding the recoil assembly within the slide assembly, wherein the slide assembly is comprised of a front casing slidingly engaged with the barrel assembly and a rear casing slidingly engaged with the frame, wherein the front casing further comprises a pair of apertures and an internal recess, wherein the recoil assembly is mounted within the front casing and is comprised of a recoil rod with a nose portion at one end, a sleeve mounted within the housing in the barrel assembly, and a recoil spring around the recoil rod with a first end of the spring pressed against the nose portion and a second end of the spring contained in the sleeve, wherein the nose portion is comprised of a cylindrical bore situated between the pair of circular apertures in the front casing, wherein the second pin is comprised of a pin body and a pin arm with a locked position and an unlocked position, wherein a proximal end of the pin arm is fixedly attached to a first end of the pin body, wherein the pin body has a first longitudinal axis and the pin arm has a second longitudinal axis that is substantially perpendicular to the first longitudinal axis, wherein the pin body extends through the circular apertures and the cylindrical bore to a second end, and wherein a distal end of the pin arm is in flush contact with an exterior side of the front casing when the pin arm is in the locked position.

* * * * *